United States Patent [19]

Thievessen et al.

[11] Patent Number: 4,681,274

[45] Date of Patent: Jul. 21, 1987

[54] METHOD AND DEVICE FOR ATTACHING A WEB OF MATERIAL ROLLING TO THE BEGINNING OF A WOUND FRESH WEB

[75] Inventors: Karl Thievessen, Grevenbroich; Peter Weiss, Neuss, both of Fed. Rep. of Germany

[73] Assignee: Jagenberg Aktiengesellschaft, Dusseldorf, Fed. Rep. of Germany

[21] Appl. No.: 793,522

[22] Filed: Oct. 31, 1985

[30] Foreign Application Priority Data

Nov. 2, 1984 [DE] Fed. Rep. of Germany ..... 3440107
Apr. 23, 1985 [DE] Fed. Rep. of Germany ... 8511986[U]

[51] Int. Cl.[4] ..... B65H 19/18; B65H 19/12

[52] U.S. Cl. ..... 242/58.3; 242/68.4; 156/504; 156/505

[58] Field of Search ..... 242/58.1, 58.3, 58.5, 242/68.4, 58.6; 156/157, 504, 505

[56] References Cited

U.S. PATENT DOCUMENTS

| | | | |
|---|---|---|---|
| 3,106,360 | 10/1963 | Kohler | 242/58.3 |
| 3,915,399 | 10/1975 | Kron et al. | 242/58.3 |
| 4,009,841 | 3/1977 | Matalia | 242/58.3 |
| 4,518,127 | 5/1985 | Hurst | 242/58.3 |

FOREIGN PATENT DOCUMENTS 2129903 1/1973 Fed. Rep. of Germany .

2430514 4/1981 Fed. Rep. of Germany .

*Primary Examiner*—Stuart S. Levy
*Assistant Examiner*—David Werner
*Attorney, Agent, or Firm*—Sprung Horn Kramer & Woods

[57] ABSTRACT

A method of and device for attaching a web of material rolling off to a processing machine to the beginning of a fresh web that is wound on a reel. To provide a method that will inexpensively and rapidly ensure a reliable attachment between the two webs, the first web is separated upstream of a stored section with the processing machine turned off and the separated section at least partly reserved, the section of web with the second web is then forced into contact, and the end of the reserved web section attached to the beginning of the second web as it arrives by releasing the reserved web section with the processing machine in operation. The device comprises an upright with the replacement reel mounted on it, a mechanism for reserving a supply of web, and a mechanism for cutting the web. To provide a device for carrying out the method that will be simple in design and universally applicable, a transfer mechanism that accommodates at least part of a separated section of the first web and that can be forced into contact with the outer surface of the replacement reel is positioned between the cutting mechanism and a reservoir.

9 Claims, 11 Drawing Figures

METHOD AND DEVICE FOR ATTACHING A WEB OF MATERIAL ROLLING TO THE BEGINNING OF A WOUND FRESH WEB

BACKGROUND OF THE INVENTION

The present invention relates to a method of attaching a web of material that is rolling off to a processing machine to the beginning of a fresh web that is wound on a reel.

In one method of this type, known from German OS No. 2 129 903, the fresh web is attached to a moving roll that can be shifted by a traveling mechanism into a position opposite a stop roll that moves past the first web. The contact between the web that is running off and the opposing roll rotates the roll in such a way that the forward edge of the fresh web comes into contact with the web that is rolling off. Means of adhesion on the surface of the fresh web establish an attachment with the first web. Once the two webs have been attached, the first web is separated. This method of attachment generates stresses in the web that can lead to malfunction in the attachment process. Furthermore, the device employed to carry out the method takes up a lot of space in that it employs duplicate roll-off as a point of departure.

Another method is known from German AS No. 2 430 514. This method also employs duplicate roll-off, with the webs supplied to travelers that move back and forth in a traveler frame on each side of an attachment station that they can be moved into and out of. This method is also very expensive and takes up a lot of space. Furthermore, the means of adhesion, a strip of adhesive tape for instance, must be applied in the machine, which is usually especially expensive.

SUMMARY OF THE INVENTION

One object of the present invention is to provide a method of attaching a web that is running off, to the beginning of another web that is wound on a reel that will inexpensively and rapidly ensure a reliable attachment between the two webs.

This object is attained in accordance with the invention in that the first web is separated upstream of a stored section with the processing machine turned off and the separated section at least partly reserved, after which the section of web with the second web is forced into contact and the end of the reserved web section attached to the beginning of the second web as it arrives by releasing the reserved web section with the processing machine in operation.

Thus, the means of attachment, the strip of adhesive tape for example, can be applied to the arriving web outside the machine, extensively preparing the web for the subsequent attachment process. The attachment can be produced very rapidly and inexpensively because it requires no expensive duplicate roll-off or synchronizing mechanisms.

In one practical embodiment of the invention the reserved web section is first wound and then, subsequent to the forced contact with the second web, unwound again.

The attachment can accordingly be established in a very small space, no matter how long the diameter of the reel with the second web is for instance. A length of the end of the first web that depends on the orientation or position of the beginning of the second web is reserved and unwound in such a way that the end of the reserved web section and the beginning of the second web essentially overlap, facilitating rapid and reliable attachment without being affected by any free hanging end piece of the first web.

The device for attaching an off-running web to the beginning of another web arriving from a replacement reel comprises an upright with the replacement reel mounted on it, a mechanism for reserving a supply of web, and a mechanism for cutting the web.

Another object of the invention is to provide a device for carrying out the method that will be simple in design and universally applicable.

This object is attained in accordance with the invention in that a transfer mechanism that accommodates at least part of a separated section of the first web and that can be forced into contact with the outer surface of the replacement reel is positioned between the cutting mechanism and a buffer.

This device is extremely simple, especially when applied as an accessory for series off-rolling, wherein the webs can be connected as the machine is started up. The attachment can occur with both lateral and reverse reel supply and in the briefest time.

This is especially true if the transfer mechanism is a rotating suction cylinder positioned on a pivoting arm on a longitudinal beam.

The suction cylinder assumes in this case the function of a reserve mechanism that temporarily retains an appropriate length of the separated end until the wound-up section of web is unwound again as the result of forced contact with the replacement reel and the end of the reserved section of web coincides with the beginning of the second web, the beginning having been provided with an adhesion point.

In one practical embodiment of the device the axis of the pivoting arm is directly below the longitudinal beam and essentially above the maximal outside diameter of the replacement reel and the pivoting arm is essentially horizontal when at rest.

This accommodates the requisite mechanisms in the smallest possible space, allowing a new replacement reel to be introduced from the side or rear of the device.

A clamp can be positioned in the vicinity of the buffer.

A pulley can be positioned in the vicinity of the suction cylinder and the buffer roll.

The suction cylinder can, when it is in the rest position, be essentially directly below the range of motion of a roll in the buffer.

Lateral introduction of the reel is facilitated in one practical embodiment wherein at least one of two parallel posts that support the reel can be pivoted around an essentially horizontal axis.

This makes it possible to accommodate all reel diameters from the same position, with all labor, especially web insertion, being carried out from the floor. Furthermore, roll-offs of this type can be established completely above floor level and without expensive base operations.

The universal application of the device is ensured in another practical embodiment wherein the device has, or a continuous series of the devices have, a reel loader or reel remover between the uprights both along and across the direction that the webs travel in, and wherein the frame posts facing the lateral loader can be pivoted up.

The reels can be loaded in this device both along and across the web-travel direction, whether or not one or more roll-off mechanisms are positioned one after another. Lateral introduction of the supply reels means that they can be simultaneously moved in and accepted, resulting in considerable reduction of downtime. That only the post facing the loading side can pivot, and the other associated post cannot pivot, considerably simplifies the design by the way.

A particular advantage is that the roll-off devices can be equipped with a number of accessories for use from the simplest type of application to completely automatic reel loading, attaching the rolled-off web to a fresh reel, and extraction and removal of a spent core.

The unused space at the top of the device in accordance with the invention is inventively employed for accommodating and mounting a supporting frame. Thus, the axis of the pivoting post or posts is directly above a longitudinal beam that unites the uprights, and the supporting frame is positioned on the beam, pivoting at one end of the beam and supported on a transverse beam at the other end.

In one practical embodiment the pivoting post or posts are retained in the pivoted-up position by means of a catch.

Some preferred embodiments of the invention will now be described with reference to the attached drawings, wherein

DETAILED DESCRIPTION OF THE PREFERRED EMBODIMENTS

Figure 1:
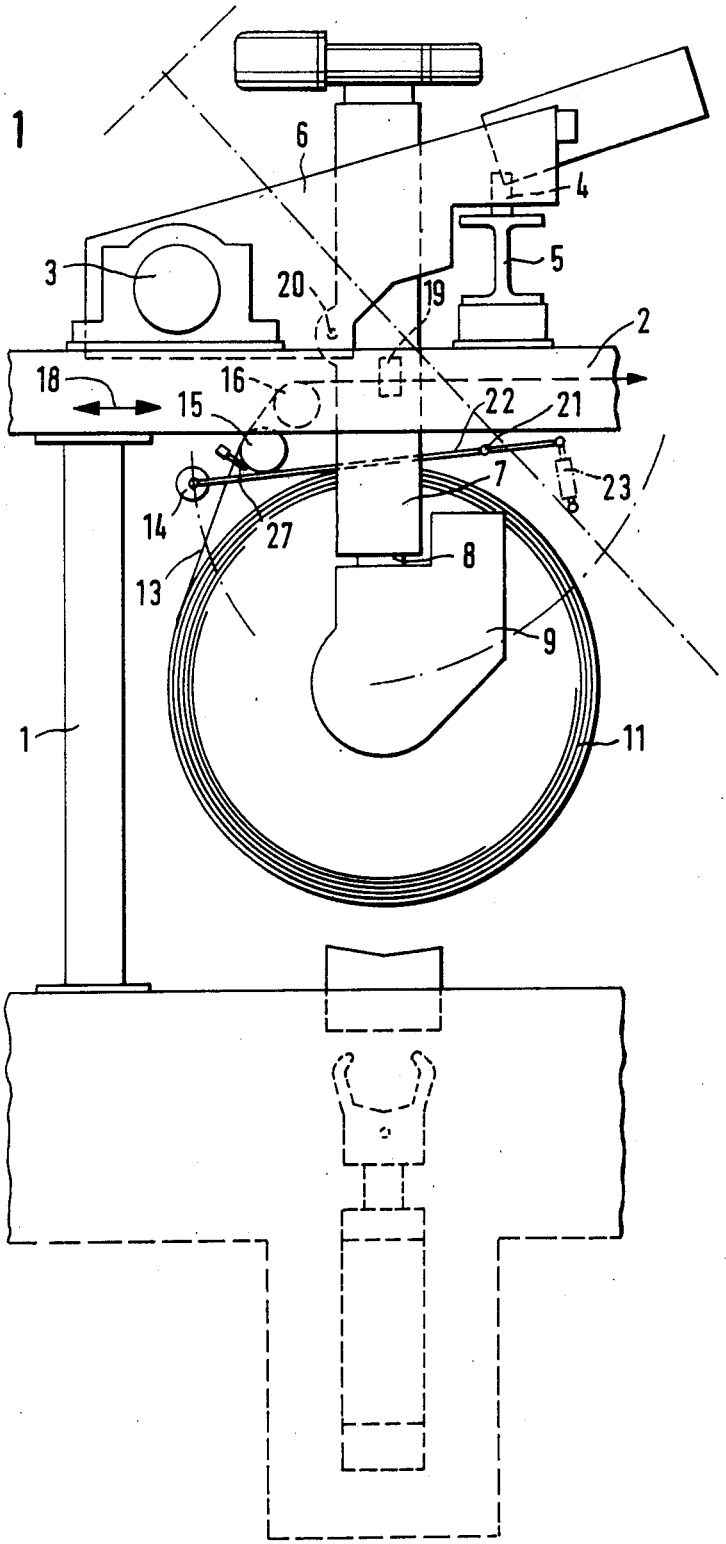
FIG. 1 is a side view of a device in accordance with the invention.

FIG. 1 illustrates a device for carrying out the method in accordance with the invention. A longitudinal beam 2 is fastened to an off-the-floor upright 1. A bearing 3 is mounted on longitudinal beam 2. Bearing 3 accommodates a supporting frame 6 that rests on rollers 4 on a transverse beam 5 in such a way that frame 6 can move transversely. Supporting posts 7 are positioned on each side of frame 6. One post 7 can be pivoted on a horizontal axis 20 over the arc indicated by the dot-and-dash line to provide lateral access for the introduction of a reel 11. Reel 11 is mounted with tensioning sleeves on piston rods 8 and tensioning heads 9 on post 7 in such a way that the reel can rotate. The web 13 that runs off it is supplied between a pulley 15 and a transfer mechanism in the form of a powered-rotation suction cylinder 14 to a roll 16 in a web reservoir. Reservoir roll 16 can be shifted back and forth in the direction indicated by double-headed arrow 18 by a drive mechanism that is not illustrated. A clamp 19 is positioned on longitudinal beam 2. Suction cylinder 14 rotates on an arm 22 that can be pivoted on an axis 21 by a schematically illustrated piston and cylinder 23. Web 13 is separated with a cutting mechanism 27.

The web travels on downstream of the reservoir to a processing machine, a transverse cutter for instance, that is not illustrated. A series of such devices can be employed in conjunction, with a web traveling to a processing machine from each device.

The function of the device in accordance with the invention will now be described.

Figure 2:
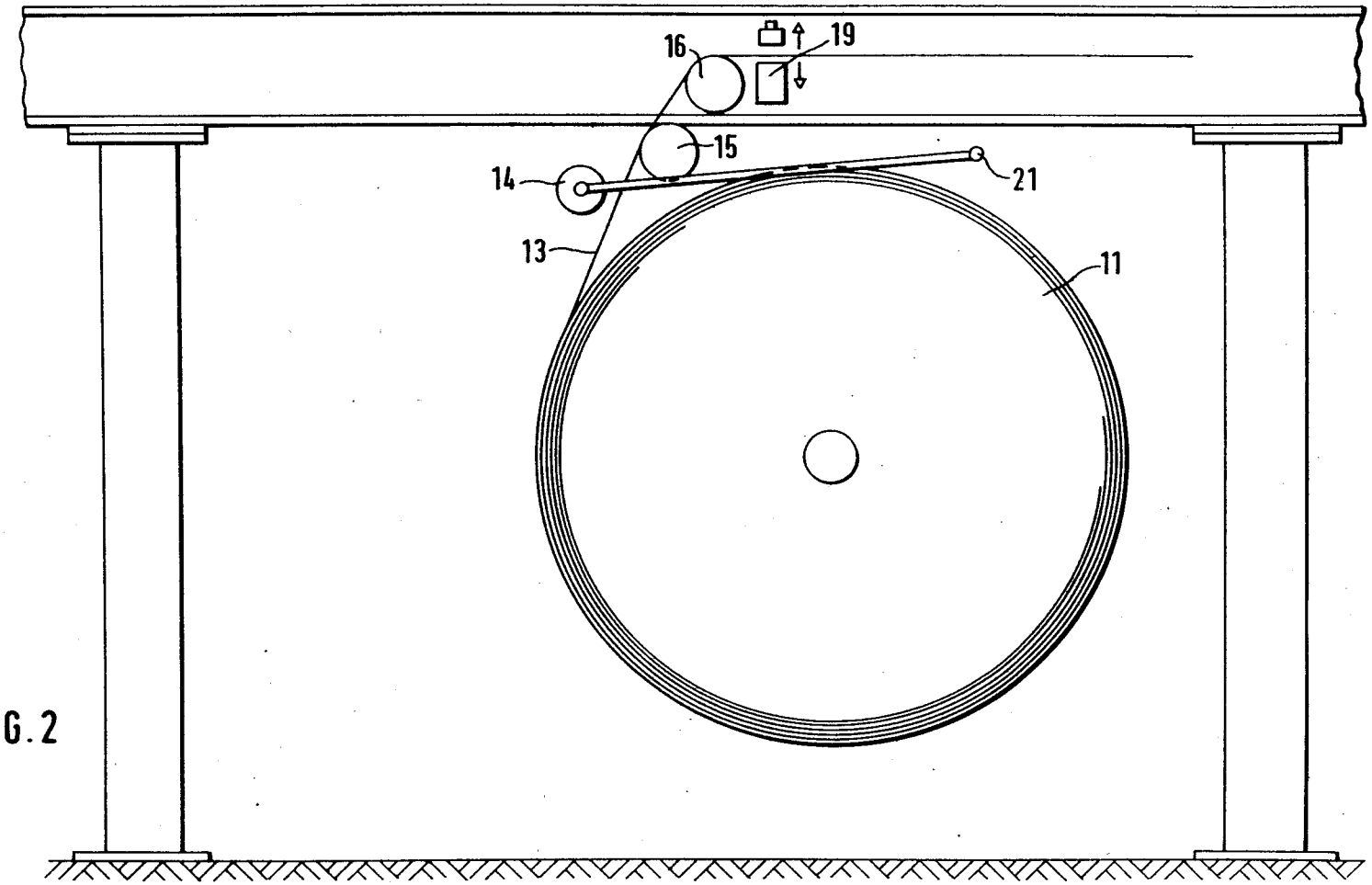
FIGS. 2 through 9 are schematic illustrations of the individual steps that occur in attaching the webs together.

From the starting position illustrated in FIG. 2 web 13 travels off a full reel 11 over pulley 15 and reservoir roll 16. Since arm 22 is in the pivoted-up position, suction cylinder 14 is not in contact with the web.

Figure 3:
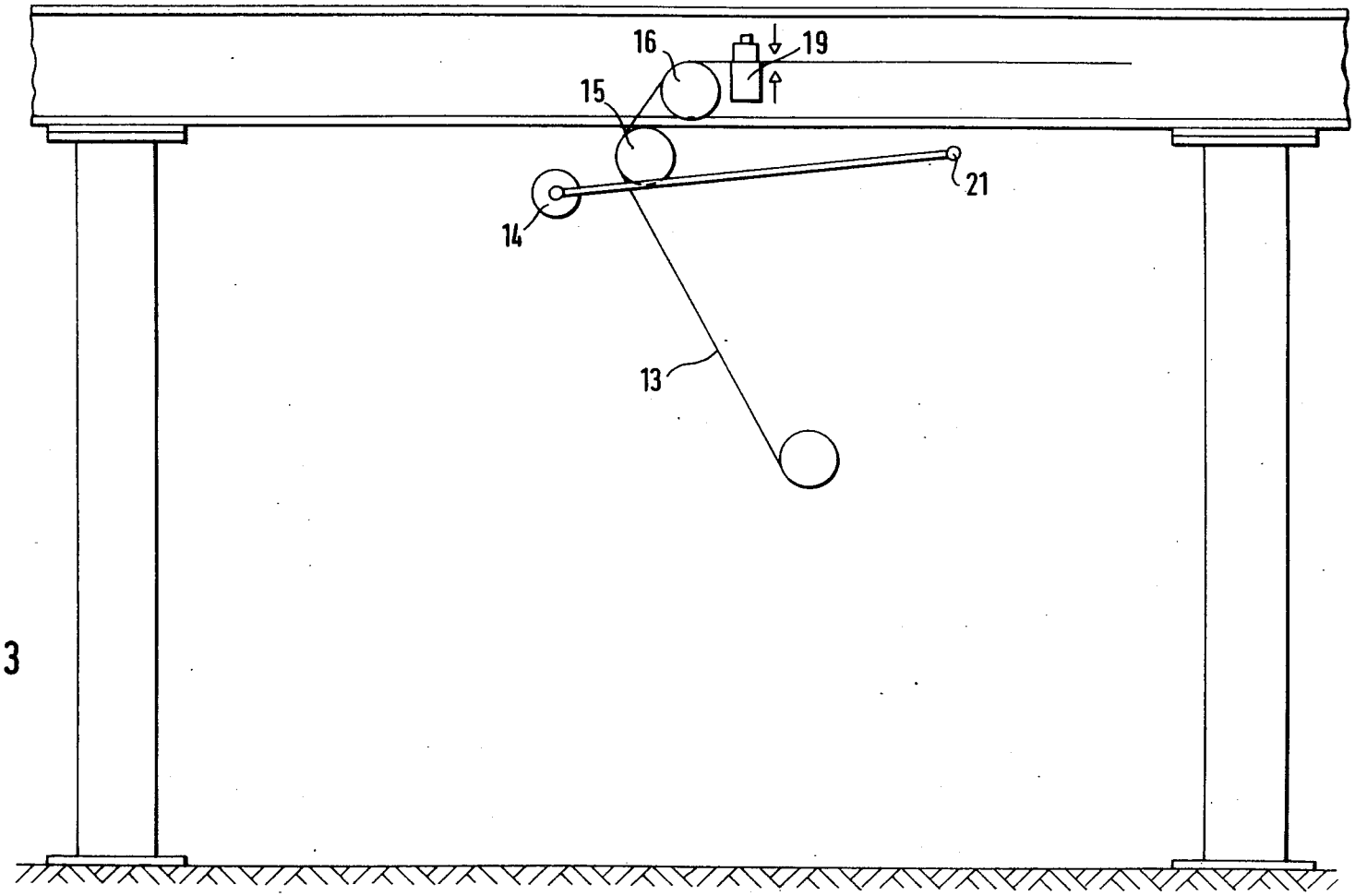

Clamp 19 is activated just before the end of web 13 as illustrated in FIG. 3.

Figure 4:
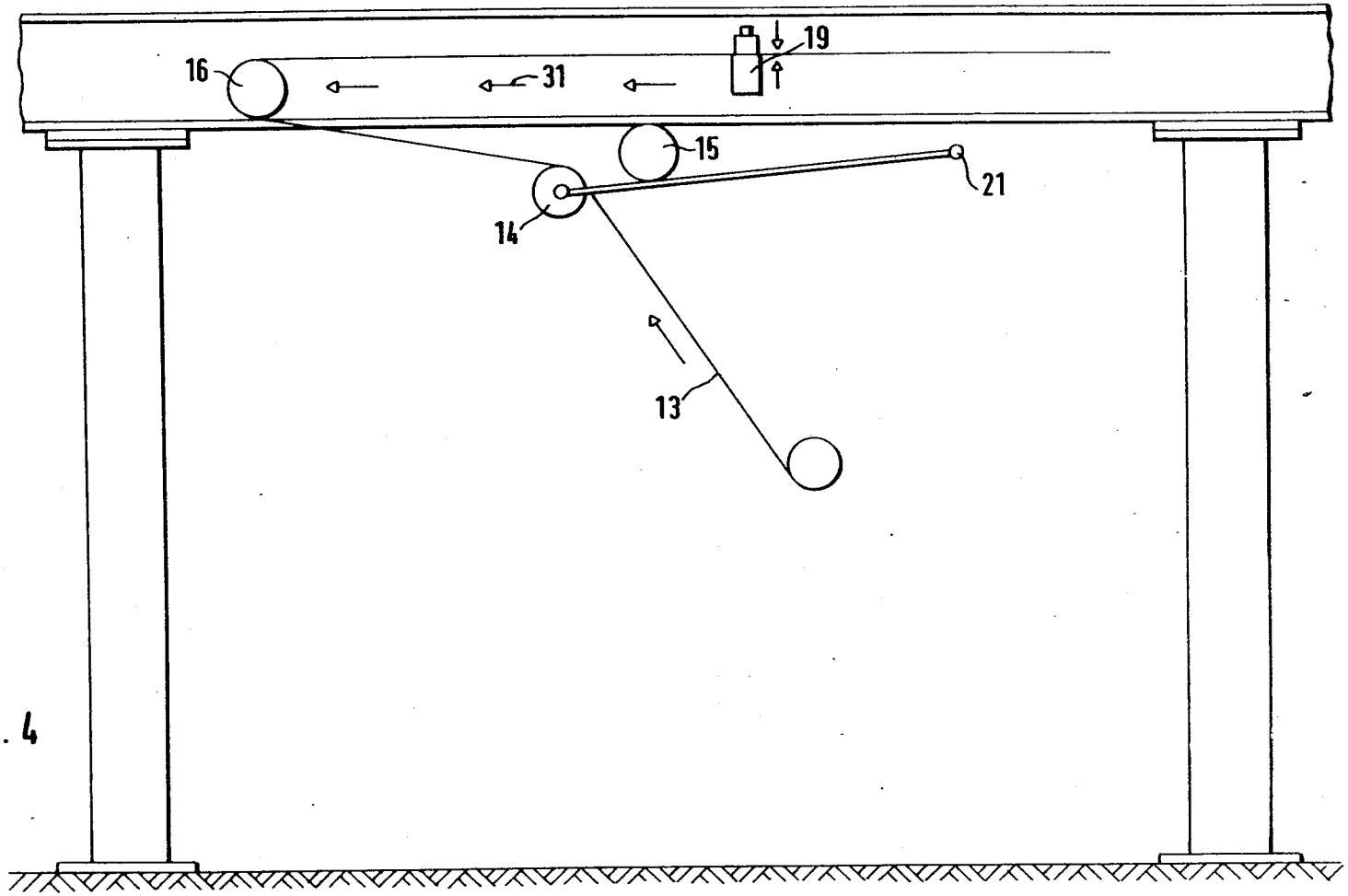

Next, as illustrated in FIG. 4, reservoir roll 16 shifts to the left in the direction indicated by arrows 31, with suction cylinder 14 remaining stationary. This provides an extended "strip" between suction cylinder 14 and reservoir roll 16 to be employed in the attachment process described in what follows.

Figure 5:
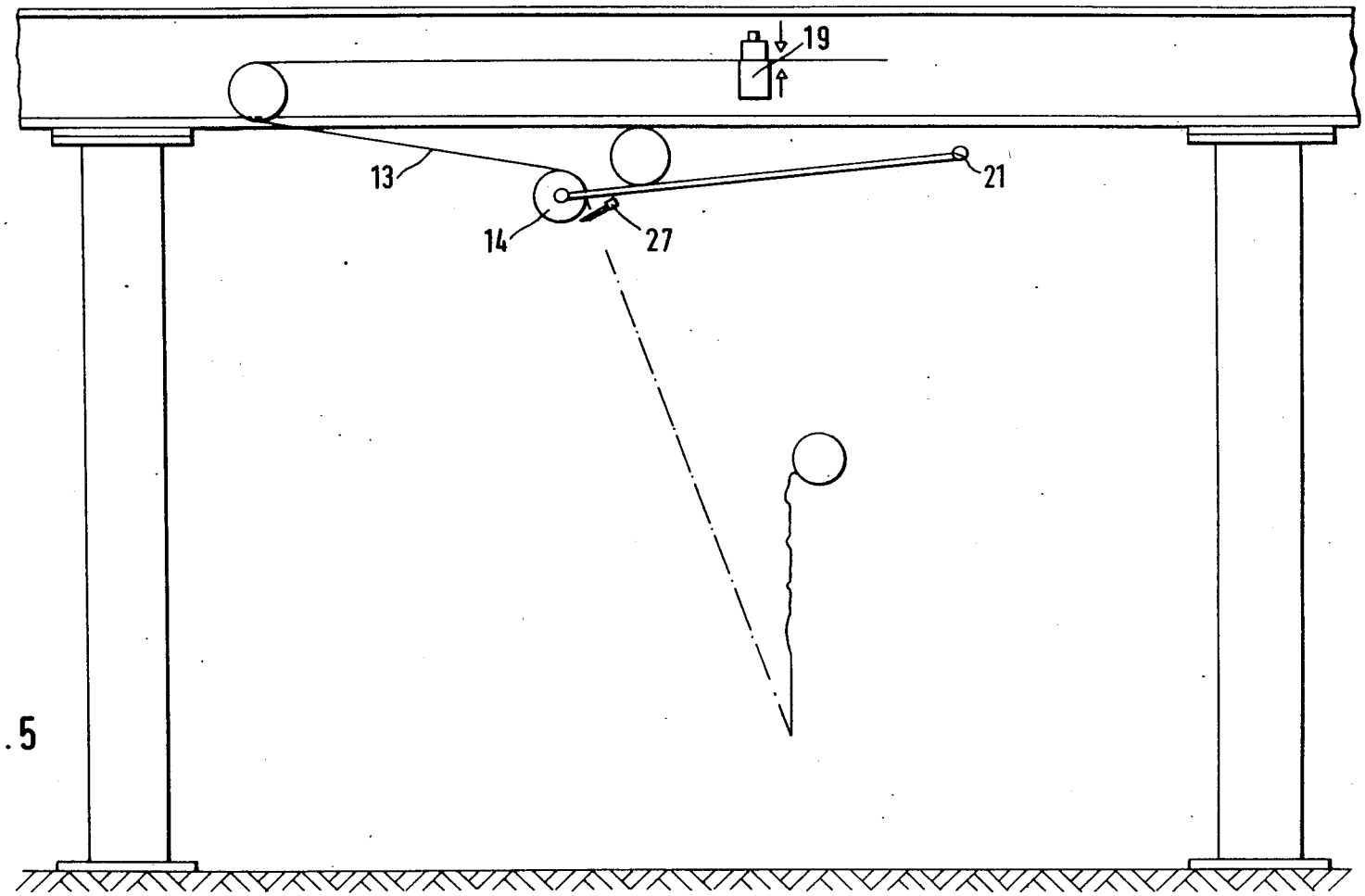

In the next stage, illustrated in FIG. 5, cutting mechanism 27 separates web 13, and the residual reel can be removed with the transverse cutter out of operation.

Figure 6:
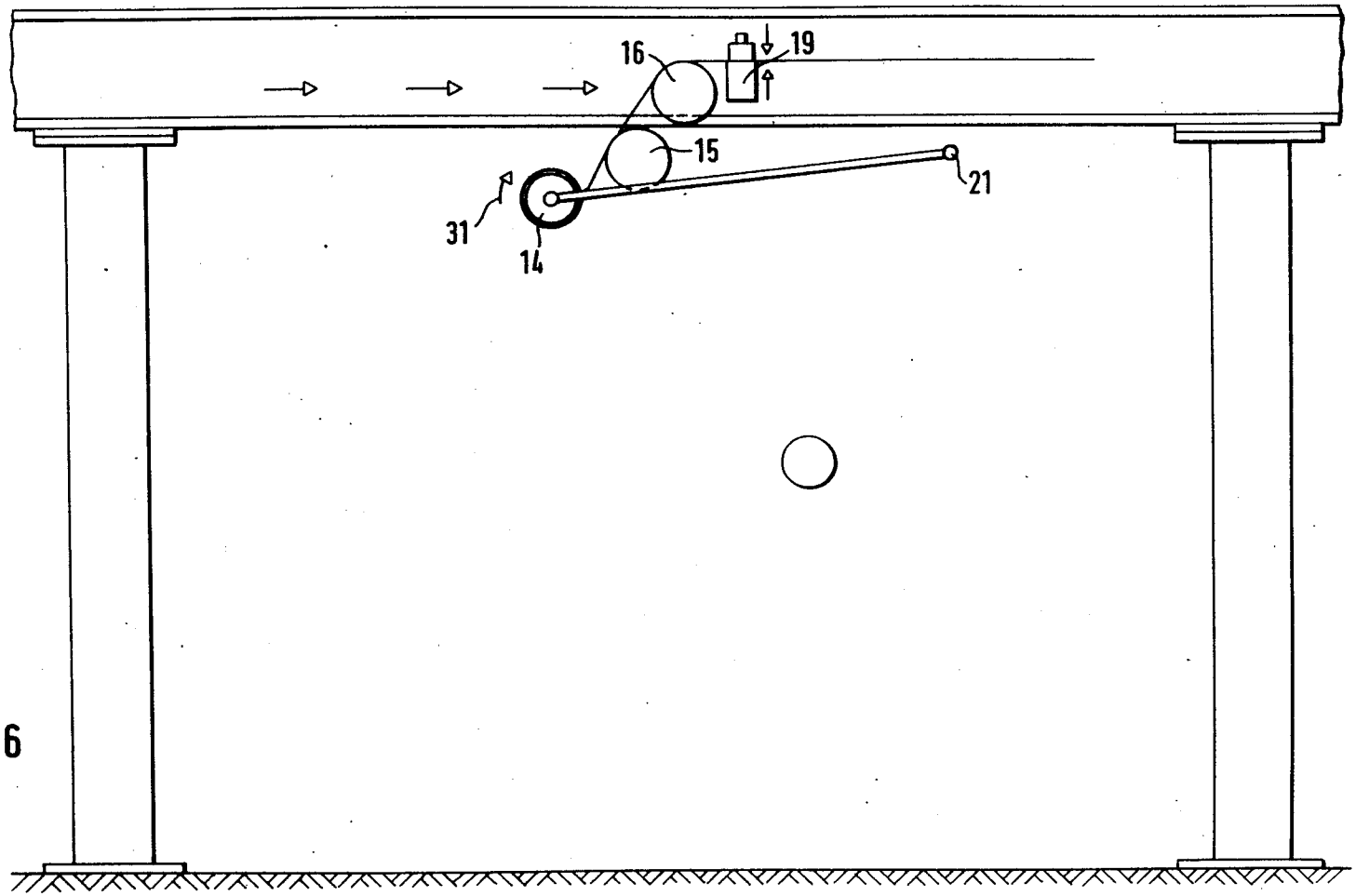

Next, as illustrated in FIG. 6, suction cylinder 14, which rotates in the direction indicated by arrow 31, picks up the extended strip of web, while reservoir roll 16 simultaneously returns to its starting position.

Figure 7:
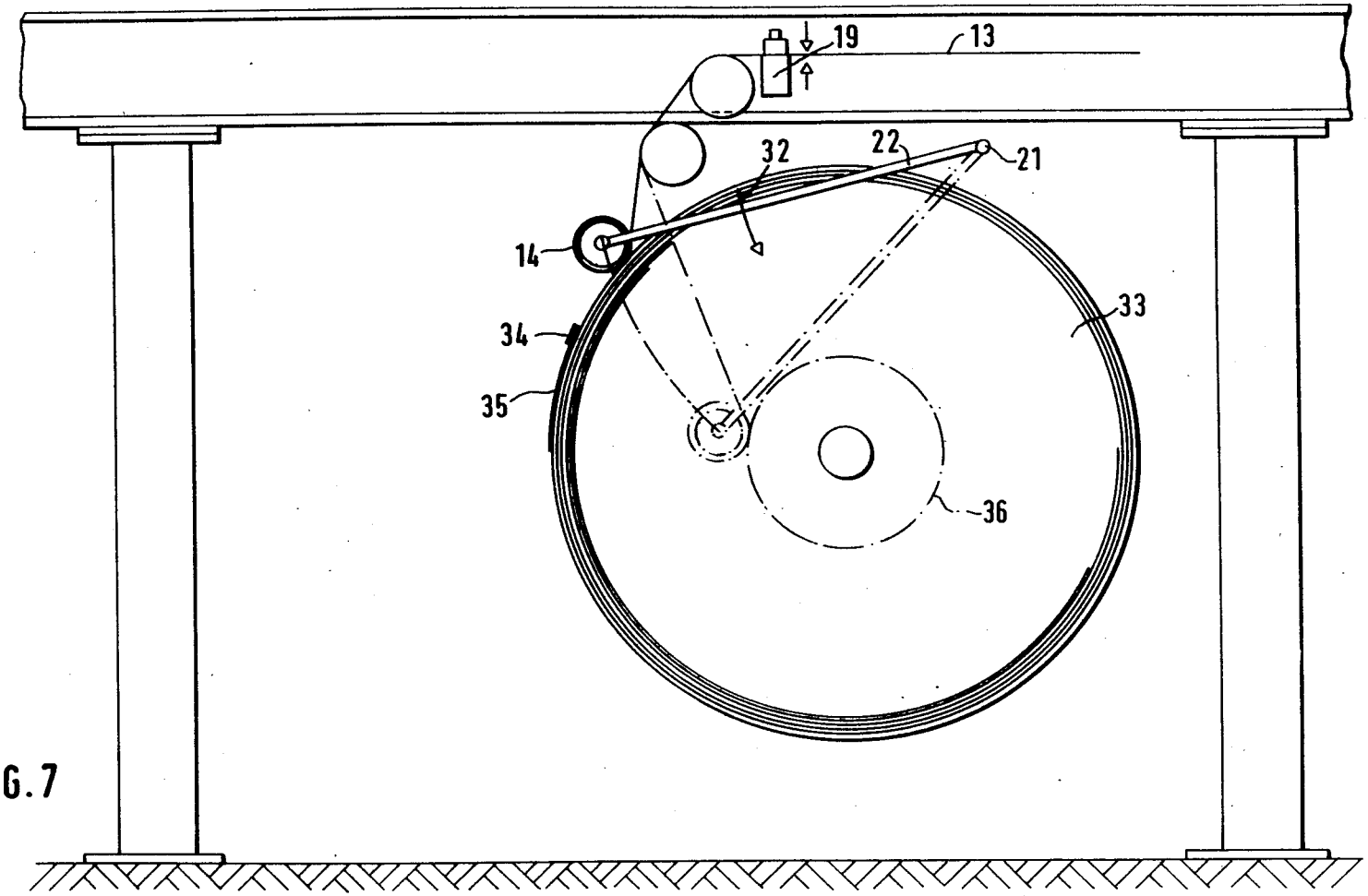

In the next stage, illustrated in FIG. 7, pivoting arm 22 moves suction cylinder 14 down in the direction indicated by arrow 32 until it comes to rest against the surface of a freshly introduced reel 33. The position of the beginning of fresh web 35, which is provided with a strip 34 of adhesive tape, and the length of the reserved section of original web 13 are related in such a way that the beginning of the fresh web and the end of the original web coincide. The pressure of suction cylinder 14 against the surface of fresh reel 33 produces a reliable attachment of one web to the other.

The dot-and-dash lines in FIG. 7 illustrate how a fresh reel 36 with an essentially shorter diameter than that of fresh reel 33 can be handled. It is only necessary for pivoting arm 22 to move suction cylinder 14 farther down, given of course that a strip of the original web that is long enough to match the diameter of the reel and the position of the strip of tape has been reserved.

Figure 8:
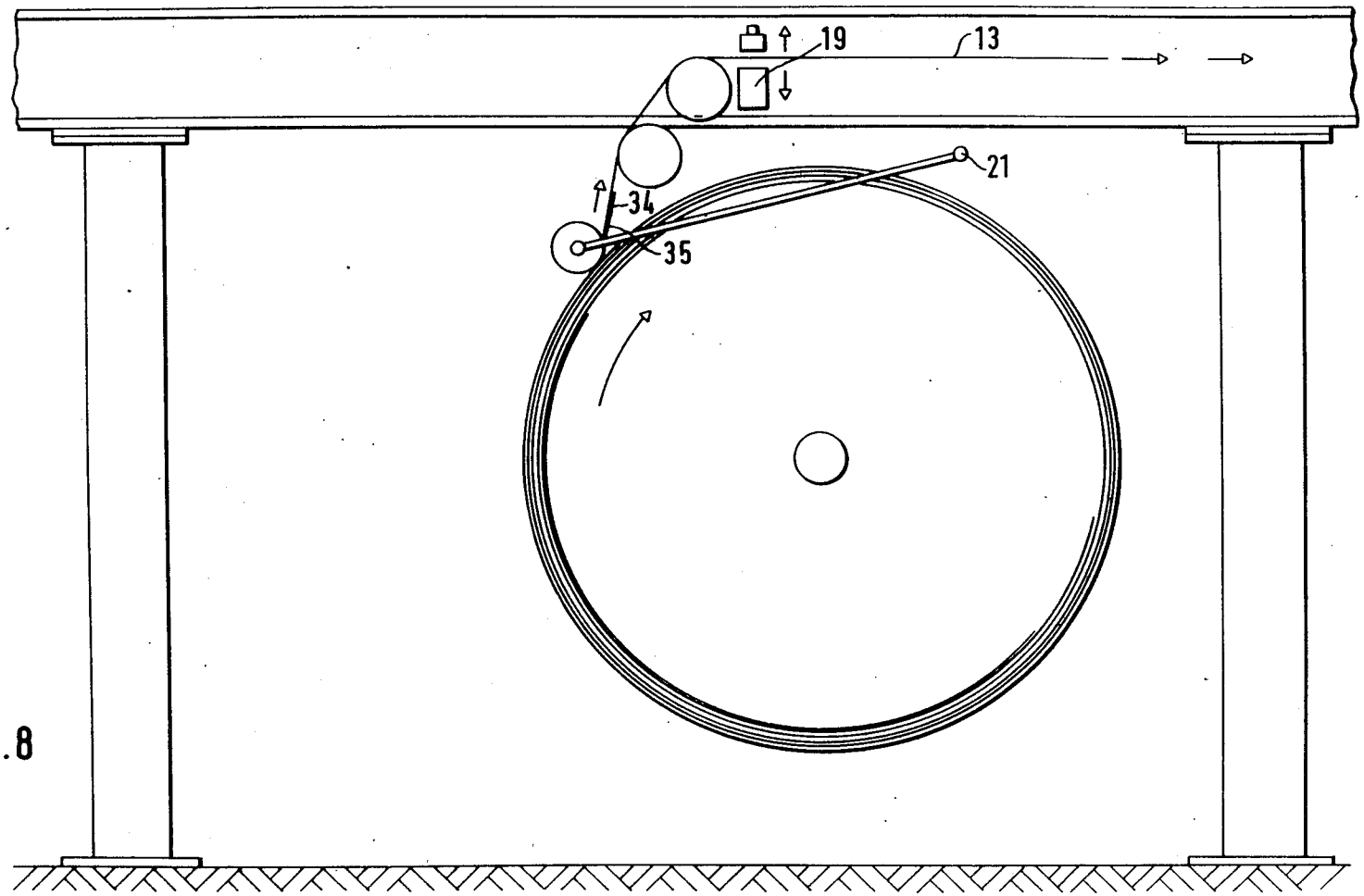

FIG. 8 illustrates how strip 34 of adhesive tape connects the end of original web 13 to the beginning of fresh web 35 during the stage when clamp 19 has been released and the processing machine started up again. The fresh web is now traveling to the processing machine as illustrated in FIG. 2 in relation to web 13. Since the fresh reel is accelerated from its stationary state only by contact with original web 13, it requires no drive or synchronization mechanisms.

Figure 9:
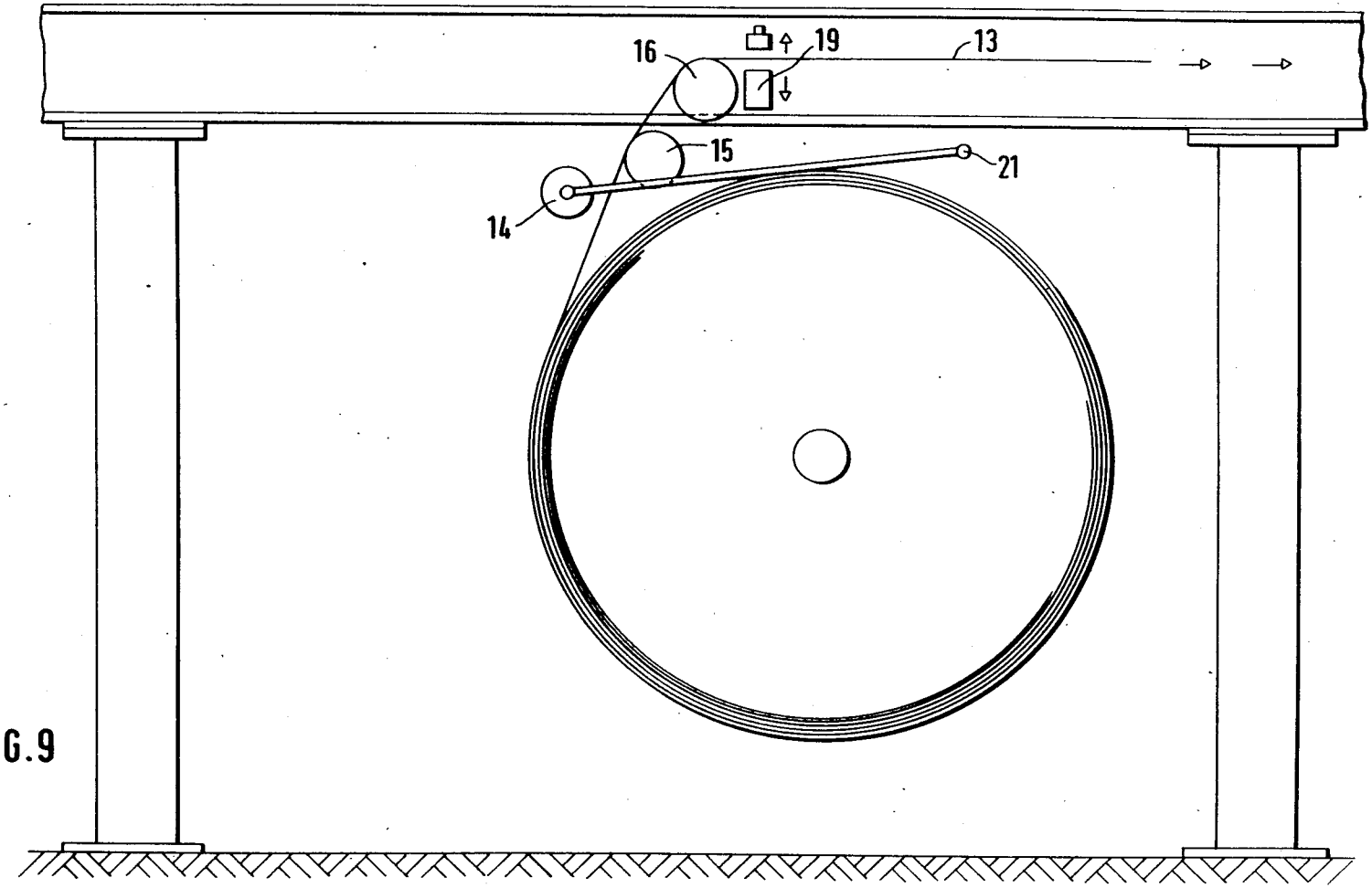

Once the webs have been attached, finally, arm 22 pivots up around axis 21 as illustrated in FIG. 9 and the position illustrated in FIG. 2 is established again.

Figure 10:
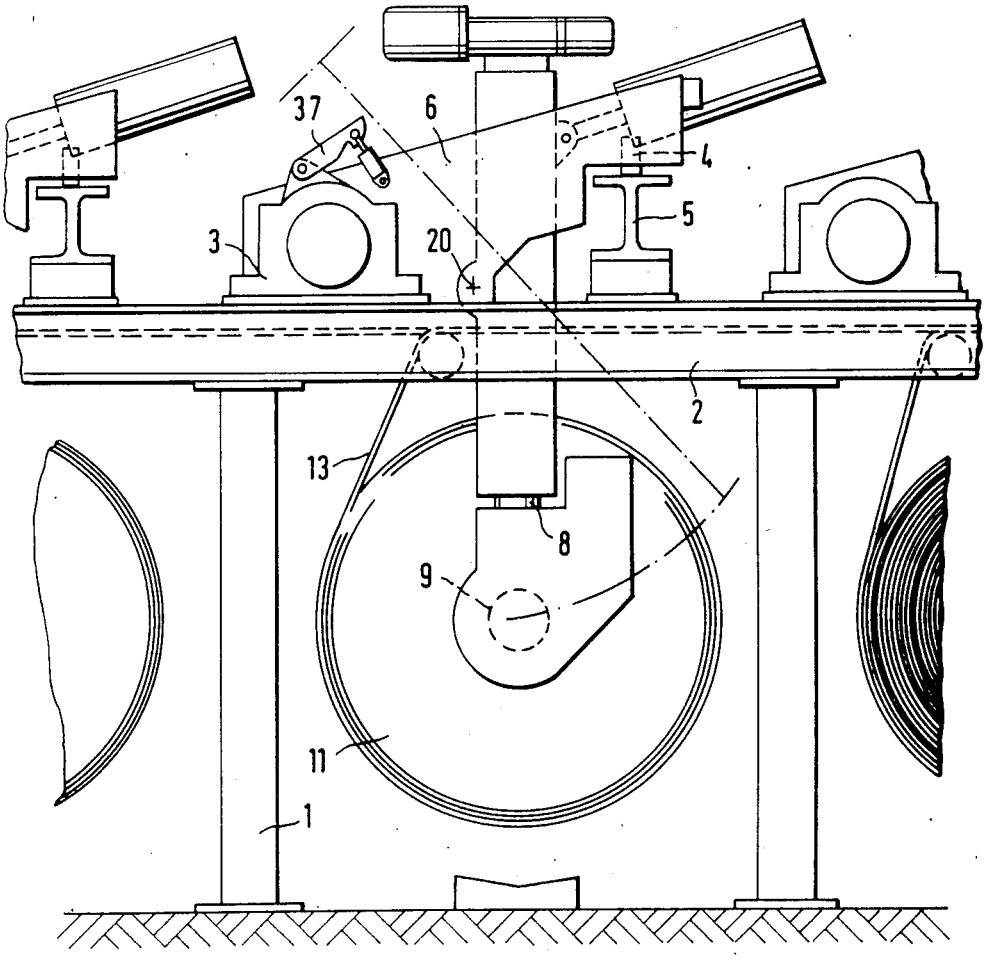
FIG. 10 is a side view of a series of roll-off devices.
Figure 11:
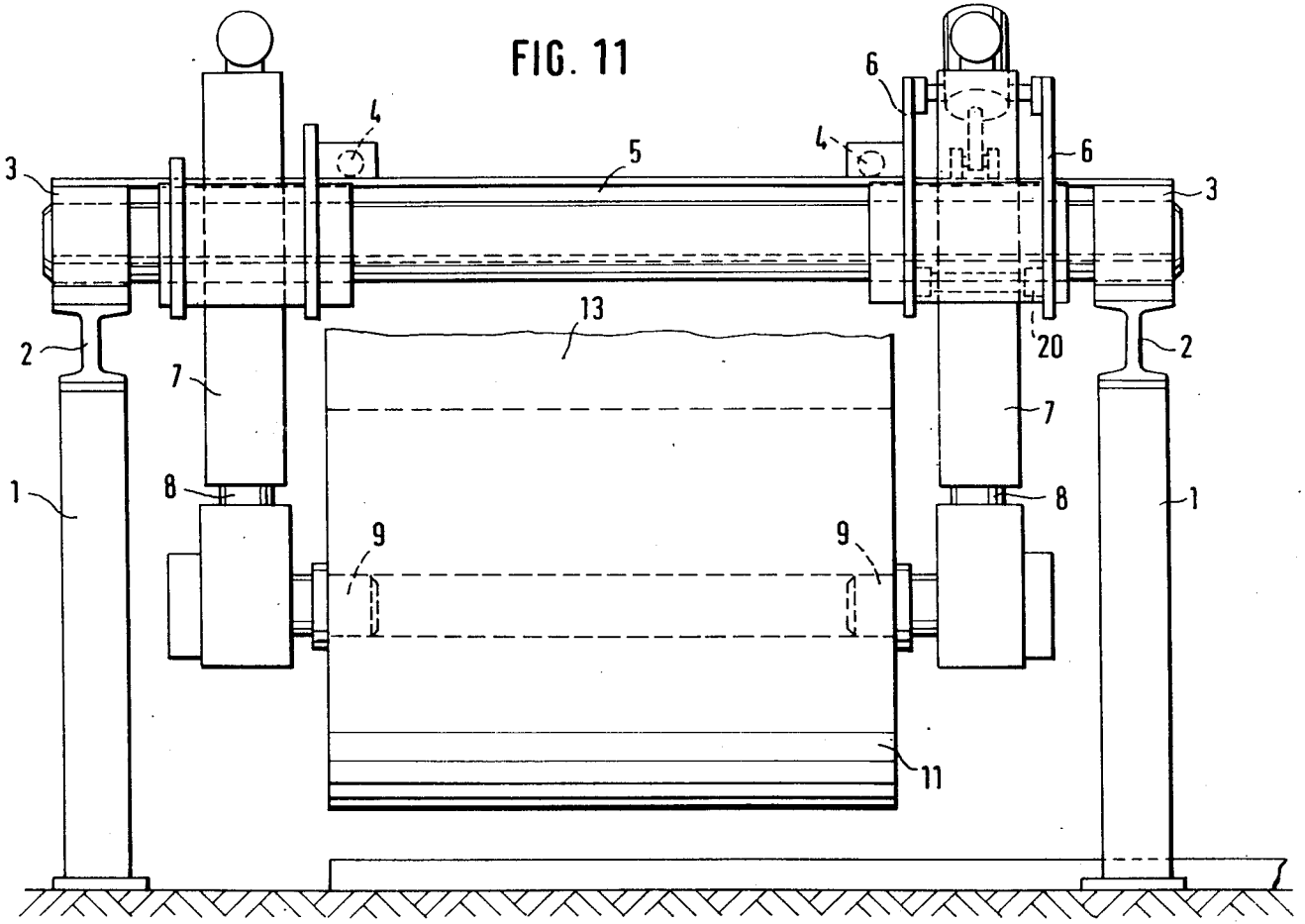
FIG. 11 is a front view of a roll-off device.

FIGS. 10–11 illustrate another embodiment of the device in accordance with the invention that consists strictly speaking of a series of three such devices. The longitudinal beam 2 is mounted on the uprights 1 of a machine that is not otherwise illustrated in detail. Longitudinal beam 2 is fastened to an off-the-floor uprights 1. Bearing 3 is mounted on longitudinal beam 2. Bearing 3 accommodates supporting frame 6 that rests on rollers 4 on transverse beam 5 in such a way that frame can move transversely. Supporting posts 7 are positioned on each side of frame 6. One post 7 can be pivoted on a horizontal axis 20 over the arc indicated by the dot-and-dash line to provide lateral access for the introduction of a reel 11. Reel 11 is mounted with tensioning sleeves on piston rods 8 and tensioning heads 9 on post 7 in such a way that the reel can rotate. The web 13 that runs off it leads to a processing machine, a transverse cutter for example, that is not illustrated. Supporting frame 6 can be shifted across the direction of travel on a transverse axis by a motorized rack and pinion for example to adjust to webs of different widths. Post 7 is retained in the pivoted position by a catch 37.

How the reels are replaced will now be described.

Supporting frame 6 is pivoted until posts 7 are upright, removing them down and out of operation until the empty reel comes to rest on a conveyor provided at that point. Once the reel has been extracted and removed, posts 7 are returned to operation and pivoted into the position indicated by the broken lines. At this stage a fresh reel is introduced from the side and the posts pivoted upright and lifted high enough for tensioning heads 9 to be inserted into the core of the fresh reel and secured. The lifting mechanism is then activated to lift the reel into the prescribed final position. Finally, the reel is prepared for splicing and attached to the end of the previously run-off web.

It is understood that the specification and examples are illustrative but not limitative of the present invention and that other embodiments within the spirit and scope of the invention will suggest themselves to those skilled in the art.

What is claimed is:

1. A device for attaching the end of an off-running first web to the beginning of another web, comprising: means for mounting a first reel having a first web for unwinding and for mounting a replacement reel with a second web upon removal of the first reel; means receptive of the first web for forming a web path during unwinding wherein the web path forming means includes means for extending the length of the web path when not unwinding to reserve a portion of the first web; means for cutting the first web upstream of the reserved portion when not unwinding; and transfer means for moving the reserved portion of the first web into contact with the outer surface of the second web on the replacement reel while the replacement reel is stationary with no relative longitudinal movement between the first and second webs.

2. The device as in claim 1, wherein the mounting means comprises a longitudinal beam and the transfer means comprises a rotating suction cylinder pivotally mounted on the longitudinal beam.

3. The device as in claim 2, wherein the cylinder is mounted on a pivoting arm having a pivot axis directly below the longitudinal beam and essentially above the maximum outside diameter of the replacement reel.

4.' The device as in claim 1, wherein the moving means comprises a clamp positioned along the web path.

5. The device as in claim 1, wherein the transfer means comprises a rotating suction cylinder and the moving means includes a movable reservoir roll.

6. The device as in claim 5, wherein the suction cylinder has means mounting same for movement into a rest position below the reservoir roll.

7. The device as in claim 1, wherein the mounting means includes two parallel posts for supporting the first reel and thereafter the replacement reel and wherein at least one post is pivotable around an essentially horizontal axis.

8. The device as in claim 7, wherein the mounting means includes a longitudinal beam and wherein the axis of the pivoting posts is directly above the longitudinal beam.

9. The device as in claim 8, further comprising a catch for retaining the pivoting post in the pivoted-up position.

* * * * *